US005977707A

United States Patent [19]

Koenig

[11] Patent Number: 5,977,707

[45] Date of Patent: Nov. 2, 1999

[54] LAMP FILAMENT AND LAMP FILAMENT ASSEMBLY

[76] Inventor: Erl A. Koenig, 108 Stone Camp Way, Averill Park, N.Y. 12018

[21] Appl. No.: 08/874,701

[22] Filed: Jun. 13, 1997

[51] Int. Cl.[6] ..... H01K 1/50

[52] U.S. Cl. ..... 313/578; 313/631

[58] Field of Search ..... 313/578, 583, 313/631, 316, 343, 344

[56] References Cited

U.S. PATENT DOCUMENTS 4,584,438 4/1986 Koenig .

4,806,834 2/1989 Koenig .

5,079,475 1/1992 Gerlings et al. ..... 313/279

*Primary Examiner*—Vip Patel

*Attorney, Agent, or Firm*—Klauber & Jackson

[57] ABSTRACT

A method and device which includes the integration of a left directed lamp filament connected electrically parallel to a right directed lamp filament, wherein the filaments coils are formed in mirror image symmetrical relationship with each other to increase radiating surface skin and to balance electromagnetic signature, thereby constructively improving lamp performance.

17 Claims, 2 Drawing Sheets

PRIOR ART INTEGRATION

LAMP FILAMENT AND LAMP FILAMENT ASSEMBLY

This Application is based on the Disclosure Document No. 378,142 filed with the U.S. Patent and Trademark Office on Jun. 14, 1995 which is incorporated in its entirety as if fully set out herein.

BACKGROUND OF THE INVENTION

As is known, a traditional electrified filament is a light bulb component that emits light which is measured in lumens. The lamp filament winding is usually formed with many coils to increase the filament surface area in order to emit a desired amount of light when the filament is electrified. It is also known that a lamp filament is surrounded by a transparent or translucent jacket or envelope which maintains a vacuum around the filament. Traditionally, where a single light bulb is required to supply a large amount of light, similar filaments in varying arrangements are mounted inside the evacuated envelope, and the filaments are electrically connected in parallel.

It is also well known that when two or more coiled filaments may be arranged in a single light bulb assembly, the coils of the filaments are formed in the same direction. The coil-forming-direction is also known as the pitch direction, which can be left or right. Furthermore, the pitch creates an angle of inclination. Flat spiral filaments which generally are wound in a single plane are also known. The number of coils over a given length, or the number of rotations for a flat formed spiral architecture, typically depends upon desired performance or design constraints. Furthermore, the integration of two or more lamp filaments possessing the same pitch direction is known, and the electric energy, light output and the assemblies dimensions of such devices are also known. Each similar-pitch filament that is circuit integrated will experience mutual induction, as is also known.

Given the known technology regarding light bulb in lamp filaments, it is very desirable to provide a longer life, more energy efficient filament or light bulb. Even small increases in efficiency can give rise to large overall energy savings, given the pervasiveness of light units in the world today.

U.S. Pat. Nos. 4,584,438 and 4,806,834, which are both hereby incorporated by reference in their entirety, describe "mirror image symmetry" wherein an electric coil forms architecture that possesses an electromagnetic signature that is balanced for the two windings.

However, in the present invention, the balance results from the left pitch angle of inclination of the first circuit canceling the right pitch angle of inclination of the second circuit, wherein the angle of the inclination relates to distortion created by the coiling. Moreover, the present invention does not require a core disposed within the coils of a filament. Furthermore, the '438 and '834 patents are directed to configurations related to transducers or inductive devices.

One object of the present invention is to constructively improve lamp performance, including improvements in the life of the filament which result from an integration of two filaments that possess a balanced electromagnetic signature.

Another object of the present invention is to increase the amount of light produced by a lamp filament for a given amount of input energy.

Another object of the present invention is to create a condition whereby the motion force caused by the electromagnetic signature of a first electrified filament is balanced by the motion force caused by the electromagnetic signature of a second filament.

The citation of any references herein should not be deemed as an admission that such reference is available as prior art to the invention.

SUMMARY OF THE INVENTION

Thus, an object of the present invention is to construct a lamp filament for less cost, last longer, is brighter and does not consume as much energy as prior art.

The present invention improves filaments life by addressing vibration and torque motion which contribute to filament material fatigue, which, when substantial, will promote premature filament failure. Thus, the electromagnetic signature of a first electrified filament is balanced by the motion force caused by the electromagnetic signature of a second filament.

The present invention also addresses the brightness of light produced by an amount of filament material and increasing that brightness of light from the same amount of energy by increasing radiating surface area of the filament without changing the filament material cross section area and characteristic impedance. The characteristic impedance of a material is a condition that results from electrical resistance and counter electromotive force also known as back EMF. The back EMF is influenced by the electromagnetic signature of a circuit and the integrating of a first electric circuit with that of a second electric circuit.

For example, a one inch square cross section area has a perimeter or circumference skin dimension four (4) inches. If the one inch square cross section area is split into two one half inch square cross section areas, the perimeter or circumference skin dimension has a six (6) inch dimension. Thus, the surface skin area increases 50% when a material's cross section area is split in half and then integrated.

With regard to increasing filament brightness, an additional improvement results when the cross section shape of the filament is changed from the traditional round or cylindrical shape to a shape that is open from a centrally inner location to the outside. The shape may be generally by the letter "U", i.e. a U-Shaped filament. The "U" cross section shape has more radiating surface skin when compared to alternative shapes possessing identical cross section area.

The "U" shape filament material is applicable for a coil from as well as for a flat spiral form. The manufacturing methods and techniques to produce lamp filaments for light bulbs are well known to those skilled in the art.

Lamp filament material and performance is constructively improved by providing a "mirror image symmetry" integrating circuit architecture for supporting two electrically parallel connected circuits that compliment each other's winding angle or inclination distortion, and further increases radiating surface skin for producing an increase in light output without increasing the electric energy output and, in a particularly preferred embodiment, utilizes an "U" cross section filament material shape that improves lumen radiating surface area.

DESCRIPTION OF THE DRAWINGS

FIG. 9 illustrates a given perimeter or circumference skin dimension for a given cross-sectional area.

FIG. 10 illustrates the increase in perimeter or circumference skin dimension while maintaining the constant cross-sectional area.

DETAILED DESCRIPTION OF THE PREFERRED EMBODIMENTS

Figure 1:
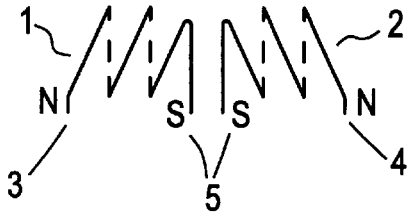
FIG. 1 illustrates a left pitch filament and a right pitch filament in axial alignment with each other.

Reference should now be made to the drawing figures, on which similar or identical elements are given consistent identifying numerals throughout the various figures thereof, and on which parenthetical references to figure numbers direct the reader to the view(s) on which the element(s) being described is(are) best seen, although the element(s) may also be seen on other views.

FIG. 1 illustrates a first coiled left pitch filament 1 with a starting end 3 and a finishing end 5 positioned next to a second coiled right pitch filament 2 with a starting end 4 and a finishing end 5.

Figure 6:
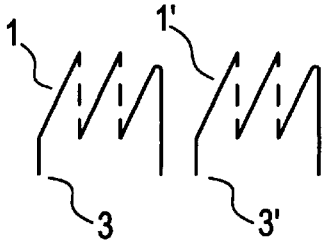
FIG. 6 illustrates a prior art integration of two left pitch filaments.

The electromagnetic signature that results from the integration of, for example, a first left pitch filament winding with a second left pitch filament winding, as shown in FIG. 6, is not as efficient when compared to the electromagnetic signature that results from the integration of, for example, a first left pitch filament winding with a second right pitch filament winding.

Figure 2:
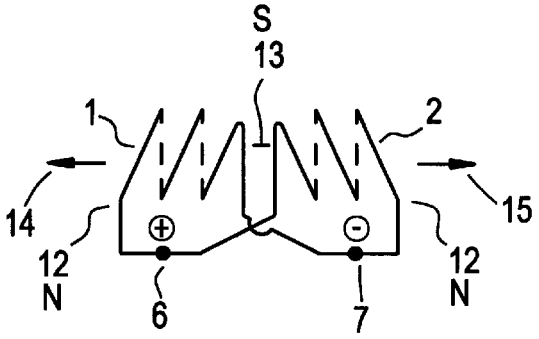
FIG. 2 illustrates a particularly preferred embodiment of the present invention comprising an electric circuit integration of a left pitch filament and a right pitch filament in parallel electric connection for maximizing the light-giving efficiency of the filament.

FIG. 2 depicts a particularly preferred embodiment of the present invention comprising an electric circuit integration of a first coiled left pitch filament 1, north pole location 12, consequent south pole location 13 with left pitch electromotive force direction 14 electrically connected in parallel by terminal 6 positive and terminal 7 negative to a second coiled right pitch filament 2, north pole location 12, consequent south pole location 13 with right pitch electromotive force direction 15.

Figure 11:
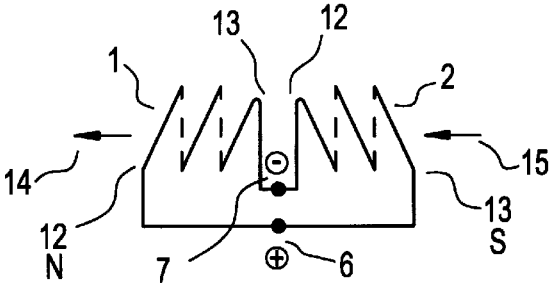
FIG. 11 illustrates another embodiment of a lamp filament assembly wherein a left pitch filament and a right pitch filament are energized in parallel.

The electromagnetic signature for integrating the balanced left pitch filament with a right pitch filament, as shown in the parallel electric connection in FIG. 2 has been found to be more efficient than for the parallel electric FIG. 11 connection.

Figure 3:
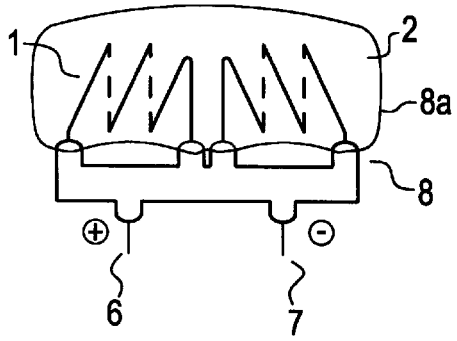
FIG. 3 shows another aspect of the present invention wherein a double coil filament is mounted in a support mount.

FIG. 3 shows another aspect of the present invention comprising a support mount 8 integrating a first coiled left pitch filament 1 to a second coiled right pitch filament 2 with a terminal 6 positive and a terminal 7 negative. The electrical circuitry connecting the terminals 6, 7, also referred to as taps, to the filaments 1, 2 is imbedded or surrounded by the mount 8, also referred to as a base, and is not shown in the Figure. The coils are preferrably enclosed within a light transmissible envelope 8*a*.

Figure 4:
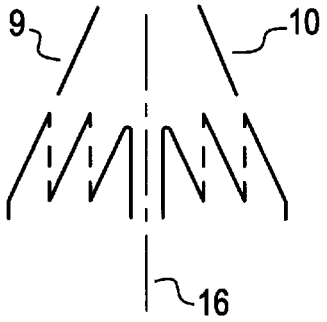
FIG. 4 schematically illustrates a left pitch filament and a right pitch filament symmetric about a center plane.

FIG. 4 demonstrates the center plane 16 midway location between a left electromagnetic angle of inclination distortion 9 and a right pitch electromagnetic angle of balanced inclination distortion 10.

Figure 5:
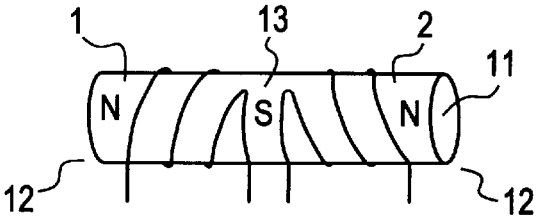
FIG. 5 shows a left pitch filament and a right pitch filament formed on a mandrel.

FIG. 5 shows a first coiled left pitch filament 1 with north pole location 12, consequent pole location 13 wound in mirror image symmetry relationship to a second coiled right pitch filament 2 with north pole location 12, consequent pole location 13 formed on a mandrel 11, as would occur when the left pitch filament 1 and the right pitch filament 2 are electrically connected as shown in FIG. 2, according to the present invention.

FIG. 6 illustrates a prior art integration having a first coiled left pitch filament 1 with left pitch coiled filament starting end 3 next to a similar second coiled left pitch filament 1 with a left pitch coiled filament starting end 3.

Figure 7:
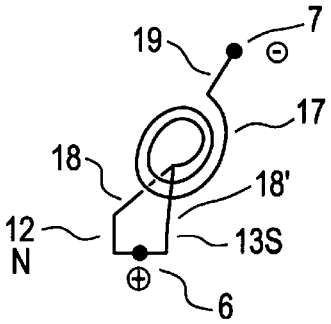
FIG. 7 shows a flat filament spiral formed architecture according to the present invention.

FIG. 7 shows a flat filament spiral formed architecture 17 according to the present invention where two starting leads 18, 18' are connected to the starting end of the spiral 17 whereby one starting lead 18 is led to the magnetic north pole location 12, and whereby the other starting lead 18' is led to the opposite magnetic south pole location 13. The two starting leads 18, 18' are joined together to become positive electric terminal filament circuit connection 6. Flat filament spiral finishing end 19 becomes negative electric terminal filament circuit connection 7. Thus, a filament material, such as tungsten, may be looped in the form of a flat spiral possessing two inner integrated electric contacts that simultaneously electrify and magnetically polarize the spirals magnetic north pole face location and magnetic south pole face location for a synchronized magnet pole signature.

Figure 8:
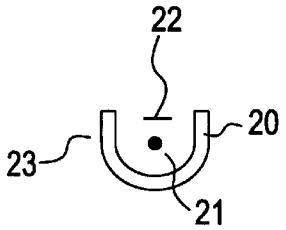
FIG. 8 shows a particularly preferred cross section of a strand of a filament.

FIG. 8 shows a filament material cross section shape 20 according to the present invention having an open end 22 that is open from a central inner location 21 to the outside 23. In a particularly preferred embodiment, the cross section shape is generally U-shaped.

Figure 9:
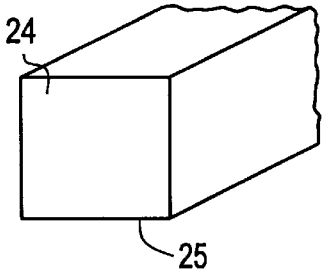
FIGS. 9 and 10 illustrate the effect of increasing the circumference skin dimension or surface area while keeping cross-sectional area constant.
Figure 10:
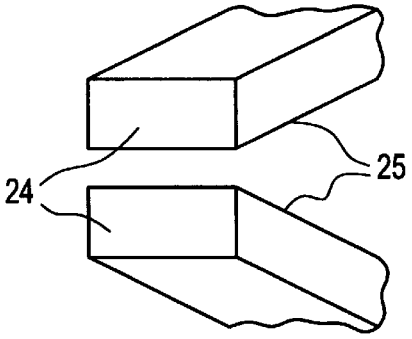

FIGS. 9 and 10 illustrate increasing the circumference skin dimension or surface area while keeping cross-sectional area constant.

FIG. 9 illustrates a material cross section area 24 of one inch square possessing a perimeter or circumference skin dimension 25 of four inches.

FIG. 10 illustrates a material cross section area 24 of a first one half inch square including a material cross section area 24 of a second one half inch square possessing an integrated perimeter or circumference skin dimension 25 of six inches.

Thus, FIGS. 9 and 10 roughly illustrate the increase in surface area that a lamp filament cross section as seen in FIG. 8 would have over conventional circular or bar-shaped filaments. The increased surface area results in more light radiating capacity for a given cross sectional area of impedance of a filament. Thus, the more skin surface area available, the greater the luminous output.

FIG. 11 depicts an electric circuit integration comprising a first coiled left pitch filament 1, north pole location 12, south pole location 13 with left pitch electromotive force direction 14 electrically connected in parallel by terminal 6 positive and terminal 7 negative to a second coiled right pitch filament 2, north pole location 12, south pole location 13 with a right pitch electromotive force direction 15.

The filaments or strand material may be made of tungsten or some other material known in the art. The filaments in a lamp or light bulb would typically be surrounded by a vacuum or partial vacuum in order to enhance performance, as is known in the art.

The filament may be formed around a mandrel so that a first lamp filament has a left directed angle of inclination pitch and the second lamp filament has a right directed angle of inclination pitch so that the two filaments may be electrically connected in parallel so that a consequent magnetic pole exists between the two filaments, thereby creating a balanced electromagnetic signature.

Table I lists the reference numerals found in the Figures.

TABLE 1

REFERENCE NUMERALS USED IN DRAWINGS

| | |
|---|---|
| 1,1': | left pitch filament |
| 2: | right pitch filament |
| 3,3': | left pitch coiled filament starting end |
| 4: | right pitch coiled filament starting end |
| 5: | left pitch coiled filament and right pitch coiled filament finishing ends |
| 6: | positive electric terminal filament circuit connection |
| 7: | negative electric terminal filament circuit connection |
| 8: | support mount for filaments and electric terminals |
| 9: | left pitch electromagnetic angle of inclination distortion |
| 10: | right pitch electromagnetic angle of inclination distortion |
| 11: | filament coil-forming mandrel |
| 12: | magnetic north pole face location |
| 13: | magnetic south pole face location |
| 14: | left pitch electromotive force direction |
| 15: | right pitch electromotive force direction |
| 16: | center plane midway location between filaments |
| 17: | flat filament spiral formed architecture |
| 18,18': | flat filament spiral starting ends |
| 19: | flat filament spiral finishing end |
| 20: | filament material cross section shape and characteristic impedance |
| 21: | central inner location |
| 22: | opening |
| 23: | outside location |
| 24: | material cross section area |
| 25: | perimeter or circumference skin dimension |

In an exemplary embodiment, a comparison condition was measured using circuit connection as shown in FIG. 2 to that of circuit connection as shown in FIG. 11.

A left pitch lamp filament in a first General Electric (H3, 12V. 55 Watt Halogen Bulb) was positioned in axial alignment to a right pitch lamp filament in a second narva (H2, 12V. 55 Watt Halogen Bulb) as close to each other as the bulbs class envelopes would allow.

An electrical reversing switch was inserted into the circuit so that when an electric alternating current or an electric direct current source illuminated the electrically parallel connected bulbs, the filament brightness was noticeably brighter with the circuit connection of FIG. 2 as compared to FIG. 11.

An electric volt meter was placed in the circuit to identify which connection used the least amount of electricity and produced the most amount of light. Measurements were made in a dark environment to detect differences when the first sign of light was observed. In a comparison test, the circuit connection of FIG. 2 used less electricity and produced more light than the circuit connection of FIG. 11.

It should be noted that, in FIG. 11, the magnetic pole configuration from left to right along the axis of the coils is N-S-N-S. Thus, the left pitch electromotive force direction 14 is the same as the right pitch electromotive force direction 15 in FIG. 11. However, the left and right pitch electromotive force directions 14, 15 are oppositely directed in the configuration shown in FIG. 2.

Most preferably, the north and south poles generated in the symmetric magnetic signature according to the present invention should be of substantially equal strength. Both poles are preferably polarized simultaneously.

Thus, as in the particularly preferred embodiment shown in FIG. 2, the torque and twist imparted to the spiral are minimized by providing equal and oppositely directed electromotive forces.

Moreover, the prior art integration, as shown in FIG. 6, provides two similar-pitched filaments that produce parasitic distortion to one another.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A lamp filament for providing increased luminosity and improved wear characteristics comprising:

a pair of electrical taps;

at least one looped strand having a first end and a second end;

at least one electrical connection path leading from one of said taps to said first end of said strand; and at least one other electrical connection path leading from the other of said taps to said second end of said strand;

wherein said strand and said electrical connection paths are spatially arranged to form coils aligned about a common axis; said coils being positioned to form a magnetic pole between each other to promote a balanced magnetic signature generated when electrical current is passed therethrough;

whereby movement of said strand is minimized when energized.

2. The lamp filament means according to claim 1 wherein said at least one looped strand further comprises a generally flat planar spiral having an inner end and an outer end;

wherein said at least one electrical connection path further comprises at least two electrical connection paths which lead from one of said taps to said inner end symmetrically with respect to the plane of said spiral; and wherein said at least one other electrical connection path leads from the other of said taps to said outer end.

3. The lamp filament according to claim 1 wherein said at least one looped strand further comprises at least one pair of helical coils aligned longitudinally along a common axis in mirror image symmetrical relation to each other on opposite sides of a center plane; and wherein said at least one electrical connection path further comprises first and second electrical connection paths, wherein said first path leads to one of said coils and said second path leads to the other of said coils.

4. The lamp filament according to claim 1 wherein said strand is comprised of tungsten.

5. The lamp filament according to claim 4 wherein said strand further comprises an open cross-sectional shape for increasing its skin surface.

6. The lamp filament according to claim 5 wherein said strand has a generally U-shaped cross-section.

7. A lamp filament assembly comprising:

a pair of coils aligned longitudinally along a common axis in mirror image symmetrical relation to each other on opposite sides of a center plane, wherein each coil has an outer end and an inner end.

8. The lamp filament assembly according to claim 7 wherein each end of said first coil is electrically connected to a respective end of the other said coil, thereby forming a first connection and a second connection, respectively, between said coils, and further comprising:

a first tap disposed at said first connection; and a second tap disposed at said second connection;

whereby said coils are connected in parallel.

9. The lamp filament assembly according to claim 8 wherein the inner end of one of said coils is connected to the outer end of the other said coil.

10. The lamp filament assembly according to claim 7 wherein the inner end of one of said coils is connected to the inner end of the other said coil.

11. In combination:

a light-transmissible envelope;

a base attached to said envelope and having an electrical input portion, and a filament assembly attached to said base and at least partially disposed within said envelope, said filament assembly comprising:

a mount attached to said base; and a lamp filament attached to said base, said filament including:

a pair of coils aligned longitudinally along a common axis in mirror image symmetrical relation to each other on opposite sides of a center plane, wherein each coil has an outer end and an inner end, wherein each end extends into said mount, and wherein each end of one of said coils is electrically connected to a corresponding end of the other said coil, thereby forming a first connection and a second connection disposed within said mount;

a first tap leading from said first connection and extending out of said mount; and a second tap leading from said second connection and extending out of said mount;

wherein said first and second tap are connected to said electrical input portion;

whereby said coils are connected in parallel; and whereby said filament is capable of being energized.

12. The combination according to claim 11 wherein said envelope is sealed to said base.

13. The combination according to claim 12 wherein said coils are surrounded by an at least partial vacuum.

14. The combination according to claim 11 wherein each coil has inner and outer ends, said inner end being disposed closer to said central plane than said outer end; and wherein the inner end of one of said coils is electrically connected to the outer end of the other of said coils.

15. The combination according to claim 11 wherein each coil has inner and outer ends, said inner end being disposed closer to said central plane than said outer end; and wherein the inner end of one of said coils is electrically connected to the inner end of the other of said coils.

16. A lamp filament for providing increased luminosity and improved wear characteristics comprising:

a pair of electrical taps;

at least one looped strand having a first end and a second end;

at least one electrical connection path leading from one of said taps to said first end of said strand; and at least one other electrical connection path leading from the other of said taps to said second end of said strand;

means for magnetically minimizing movement of said strand when energized.

17. The lamp filament of claim 16 wherein said magnetic minimizing means includes coil pairs formed from a spatial arrangement of said strand and said electrical connections paths and aligned longitudinally along a common axis in mirror image symmetrical relation to each other on opposite sides of a center plane; said coil pairs being positioned to neutralize the magnetic properties of each other to promote a balanced magnetic signature generated when electrical current is passed therethrough.

* * * * *